US007568533B2

(12) United States Patent
Felt

(10) Patent No.: US 7,568,533 B2
(45) Date of Patent: Aug. 4, 2009

(54) PIPEHANDLER

(76) Inventor: Rodger Lawrence Felt, 1830 S. Kirkwood Rd., Suite #102, Houston, TX (US) 77077

( * ) Notice: Subject to any disclaimer, the term of this patent is extended or adjusted under 35 U.S.C. 154(b) by 0 days.

(21) Appl. No.: 11/941,880

(22) Filed: Nov. 16, 2007

(65) Prior Publication Data

US 2009/0127001 A1 May 21, 2009

(51) Int. Cl.
*E21B 19/20* (2006.01)
*E21B 19/15* (2006.01)

(52) U.S. Cl. ..... 175/57; 175/52; 175/85; 414/22.57; 414/22.58

(58) Field of Classification Search ..... 175/52, 175/85, 57; 414/22.57–22.59, 22.61
See application file for complete search history.

(56) References Cited

U.S. PATENT DOCUMENTS 3,706,347 A * 12/1972 Brown ..... 175/85
RE28,071 E * 7/1974 Smart ..... 414/746.8
3,860,122 A 1/1975 Cernosek
3,916,500 A * 11/1975 Brown ..... 29/240
4,013,178 A 3/1977 Brown et al.
4,042,123 A 8/1977 Sheldon
4,117,941 A 10/1978 McCleskey, Jr.
4,129,221 A * 12/1978 Moller ..... 414/22.57
4,235,566 A 11/1980 Beeman
4,269,554 A 5/1981 Jackson
4,274,777 A 6/1981 Scaggs
4,379,676 A 4/1983 Frias
4,382,591 A * 5/1983 Minnis et al. ..... 269/156
4,386,883 A 6/1983 Hogan
4,403,898 A * 9/1983 Thompson ..... 414/22.58
4,426,182 A 1/1984 Frias
4,474,520 A * 10/1984 Buckner et al. ..... 414/22.61
4,494,899 A 1/1985 Hoang
4,684,314 A 8/1987 Luth
5,658,087 A 8/1997 Butkovich
6,079,925 A 6/2000 Morgan
6,543,551 B1 4/2003 Sparks
6,695,559 B1 * 2/2004 Pietras ..... 414/22.57
6,860,694 B2 3/2005 Slettedal
6,899,510 B2 5/2005 Morelli
6,969,223 B2 * 11/2005 Tolmon et al. ..... 414/22.54

(Continued)

OTHER PUBLICATIONS

Rodel Manufacturing Company, Printout of home page at www.pipehandler.com, Nov. 15, 2007, 2 pages, Houston, Texas, United States.

(Continued)

*Primary Examiner*—Shane Bomar
(74) *Attorney, Agent, or Firm*—J. Curtis Edmondson

(57) ABSTRACT

A pipe handling system is disclosed with an elongated base that is dimensioned to receive and support a movable tray in a position parallel to the base with at least two degrees of freedom of movement. The movable tray is also dimensioned to receive at least one section of pipe, and one end of the movable tray is separable from the base with a pipe positioner slidably disposed in the movable tray for transporting pipe and with a loader disposed adjacent to the movable tray that receives and feeds a section of pipe into the tray. The pipe handling system may include a movable tray having at least three degrees of freedom of movement The pipe handling system may include loaders that are extendable from the base.

9 Claims, 11 Drawing Sheets

U.S. PATENT DOCUMENTS

| | | | | |
|---|---|---|---|---|
| 7,163,367 | B2 | 1/2007 | Handley | |
| 2004/0208730 | A1* | 10/2004 | Morelli et al. | 414/22.59 |
| 2005/0092524 | A1* | 5/2005 | Herst | 175/52 |
| 2005/0152772 | A1* | 7/2005 | Hawkins | 414/22.54 |
| 2006/0124356 | A1* | 6/2006 | Gust et al. | 175/52 |
| 2007/0017703 | A1* | 1/2007 | Belik | 175/52 |
| 2007/0017704 | A1* | 1/2007 | Belik | 175/52 |
| 2008/0038094 | A1* | 2/2008 | Guidroz | 414/22.61 |
| 2008/0053704 | A1* | 3/2008 | Zachariasen et al. | 175/52 |

OTHER PUBLICATIONS

Forum Oilfield Technologies, Pipe Wranglers catalogue/brochure, Red Deer County, Alberta, Canada.

* cited by examiner

PIPEHANDLER

BACKGROUND

The inventive subject matter of this application is related to pipe handling systems in general, and swing out support systems for oil well pipe handling systems in particular.

Drilling rig platforms and derricks require a steady supply of joints of pipe to be transported both on and off the platform. Drilling rigs are well known in the arts and are typically configure with a derrick structure, a work platform (e.g. derrick floor) within the lower part of the derrick structure that is elevated above ground, and an area known as the pipe rack area where joints of drill pipe are stored prior to, during, and after drilling operations.

The installation of joints of drill pipe during drilling operations is a continuous process. The pipe that is inserted into the hole is known as a drill string. The drill string consists of individual pipe that are coupled together and inserted into the hole. Each pipe is approximately 30 feet to 40 feet in length. In a drilling operation that requires a hole of 10,000 feet, from 300-400 joints of drill pipe are in the drill string.

Joints of drilling pipe are typically transported to the drilling site by trucks that place the joints of pipe adjacent the derrick floor in the pipe rack are that store the pipe in a horizontal manner. These joints of drill pipe are then hoisted to the derrick platform (e.g. rig floor) by a number of methods. A common method to move a pipe to the derrick platform is to use a chain or wire rope to hoist the pipe to the derrick floor. The use of chain or wire rope has inherent difficulties in controlling the pipe as it is hoisted to and from the derrick floor, such, as a lack of support of the far end of the chain and the rotation of the pipe around the chain. Also, the attachment of pipe to a chain requires an operator on the ground, increasing labor costs.

There is an increased risk of operator injuries as a consequence of an uncontrolled drill pipe on the derrick floor if the drill pipe strikes the operator. Also, due to the weight of the pipe, the drilling rig itself may be damaged. Also, an uncontrolled string of pipe requires that the assembly and/or disassembly of the pipe string be stopped while the uncontrolled pipe is placed in the drill string or lowered to the ground. This stoppage of drilling operations ultimately results in lower productivity and higher drilling costs.

Recognizing the need to automate the movement of joints of drill pipe from the ground to the derrick floor, prior art solutions have been developed over the years. One class of prior art solutions supply joints of drill pipe to the derrick floor using a stationary system (e.g. a "skipjack") that provides a pipe section to a feeder mechanism which then conveys the pipe sections to the derrick floor. The prior art lifting systems adjust the feeder mechanism to the level of the derrick floor using a variety of means. For example the prior art describes a pipe handling systems that use a pair of platforms mounted in a stacked manner with independently operable pistons in a scissor-like manner. Prior art solutions also depict pipe handling systems with mechanisms for the control of pipe using a side mounting apparatus.

There is a need to continuously improve pipe handling systems to more efficiently transport pipe from the ground or pipe rack area to the derrick and rig floor. As most pipe handling systems are rented from oil field services companies, there is a need to have pipe handling systems that can be quickly and easily deployed near the derrick. Also, since the drill pipe typically ranges in standard sizes that range up to 16", there is a need for indexers to control the movement of pipe onto the drilling platform. Also to reduce the risk of drill pipe from falling during movement from the ground to the derrick floor, a latching glove provides support to one end of the drill pipe.

Mobility of the pipe handling system is of considerable importance requiring the use of adjustable and retractable stabilizers in addition to adjustable and retractable loaders.

These improvements result in the reduction of cost in drilling operations and ultimately the cost to extract oil from the ground.

SUMMARY

The present inventive subject matter overcomes problems in the prior art by providing a swing out pipe handling system with the following qualities, alone or in combination.

In one possible embodiment the inventive subject matter is directed towards a drill pipe handling system, having an elongated base being dimensioned sufficient to receive and support a movable tray in a position parallel to the base with a movable tray being movably coupled to the base at one end so as to provide at least one degrees of movement, also with a movable tray being dimensioned to receive at least one section of pipe and also with one end of the movable tray that is separable from the base; and a pipe positioner slidably disposed in the movable tray for transporting pipe; and with a loader disposed adjacent to the movable tray and when the tray is parallel to the base, and with the loader configured to receive and feed a section of pipe into the tray and with the loader in a position that is nested in or against the base or in a deployed position extending from the base. In this and other embodiments, the pipe handling system may have stabilizers for supporting the movable tray. In this and other embodiments, the apparatus for lifting the pipes to a drilling platform is done by lifting the movable tray away from the base. In this and other embodiments, the movable tray is bifurcated into right and left hand sides that are tilted inwards towards the pipe positioner in a v-like fashion. In this and other embodiments, the drill pipe is moved up and down the tray using a glove, the glove potentially incorporating a pipe holder. In this and other embodiments, the pipe positioner is moved by a chain or a cable. In this and other embodiments, the loader has a number of retractable stops for sequencing the drill pipe onto the movable tray. In this and other embodiments the movable tray is rotatable about the center axis.

In another possible embodiment the inventive subject matter is directed towards a method of moving pipe to the floor of a derrick, then: placing a drill pipe onto a side loader that is extendable perpendicularly from an elongate base, then rolling or sliding the drill pipe from the side loader onto a tray that is parallel the base and configured to receive the pipe in parallel with the base; then rotating the movable tray from the parallel position to vertically support the pipe; then raising one end of the tray with pipe to the derrick floor; and then transporting the pipe forward on the movable tray to the derrick floor. In this and other embodiments, the method includes the sequencing the drill pipes being loaded one pipe at a time. In this and other embodiments, the method describes the movement of pipes as held by a pipe holder. In this and other embodiments, the method is described where the movement of pipes are under programmatic control.

In another possible embodiment the inventive subject matter is directed towards a drill pipe handling system having an elongated base being dimensioned sufficient to receive and support a movable tray in a position parallel to the base so that the movable tray is movably coupled to the base at one end so as to provide at least three degrees of movement, wherein the movable tray is adjustable along one degree of freedom and so that the movable tray is dimensioned to receive at least one section of pipe and so that one end of the movable tray is separable from the base and a pipe positioner that is slidably disposed in the movable tray for transporting pipe and so that a loader is disposed adjacent to the movable tray and so that the tray is parallel to the base and so that the loader is configured to receive and feed a section of pipe into the tray and so that the loader is movable from a position nested in or against the base to a deployed position extending from the base.

The foregoing is not intended to be an exhaustive list of embodiments and features of the present inventive subject matter. Persons skilled in the art are capable of appreciating other embodiments and features from the following detailed description in conjunction with the drawings.

BRIEF DESCRIPTION OF THE DRAWINGS

The following figures show various embodiments of the inventive subject matter (except where prior art is noted).

DETAILED DESCRIPTION

Figure 1:
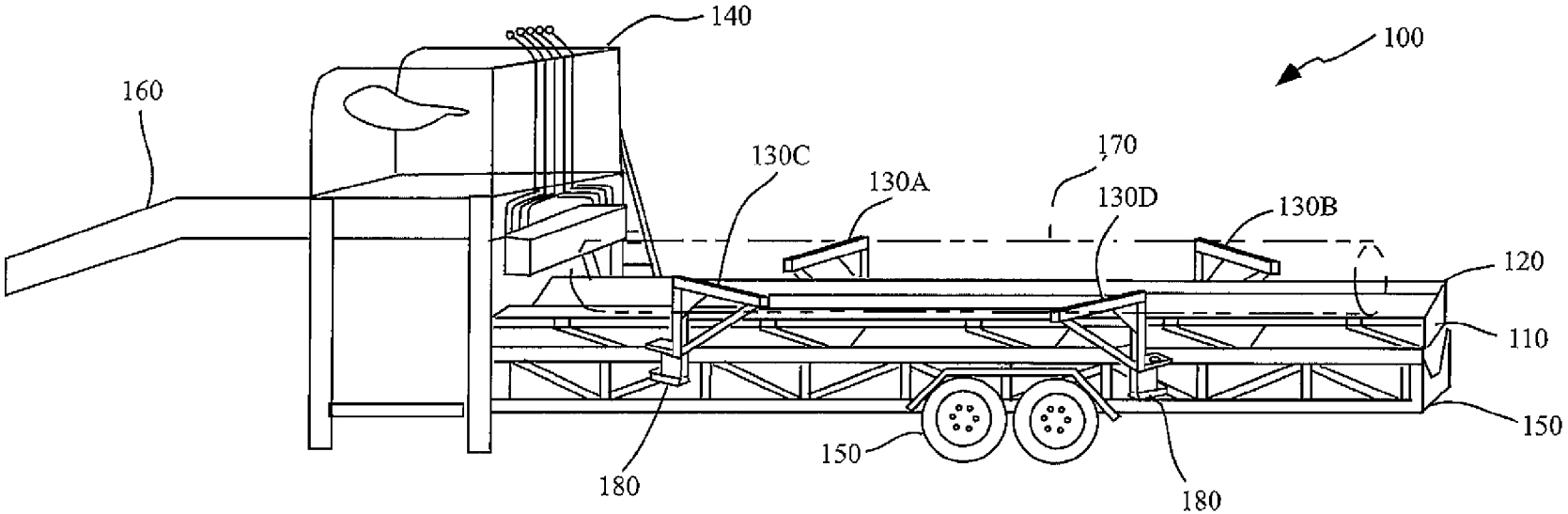
FIG. 1 shows a side view of the mobile pipe handling system.

Representative embodiments according to the inventive subject matter are shown in FIGS. 1-11, wherein the same or similar features share common reference numerals. For clarity, each reference number may refer to an item considered generally and abstractly, as well as to instances of the item in the context of one or more embodiments.

The mobile drill pipe handler is designed to be taken to a drilling location, quickly deployed, and then provide transportation of the joints of pipe from the ground to the derrick platform. Certain embodiments of the mobile drill platform provide improved movement of joints of pipe on and off the platform. Certain embodiments of the mobile drill platform also stabilize the drill pipe handler to prevent tipping or tilting of the unit.

FIG. 1 depicts a mobile drill pipe handler having a base 110, a movable tray 120, loaders 130, a control station 140, a mobile support base 150, and a hitch 160. An outline image of the drill pipe 170 is shown supported by the movable tray 130.

The movable tray 120 transports the drill pipe 170 from the ground level to the derrick platform (not shown) by one end of the movable tray 120 lifting to a level close to the derrick platform. The movable tray 120 can be configured within or on the base 110. The base 110 providing structural support to the movable platform and the associated lifting elements and also integrating wheels for mobility. The loaders 130 are depicted as pairs of loaders 130A-D on each side that swing out from the side of the base, but, the loaders may be configured in other embodiments as a single continuous surface or multiple spaced surfaces. The loaders 130A-D support the drill pipe 170 prior to movement onto the movable tray. Increased depth of the loaders 130A-D allow for the support of multiple pipes to allow for a continuous feed. The adjustment of the loaders may be manually or automatically operated. Automatic operation may be enabled by the installation of drive mechanisms near the pivot point 180 located on the base. The drive mechanism near the pivot point 180 may use an electric gear drive or a hydraulically operated piston.

Figure 2:
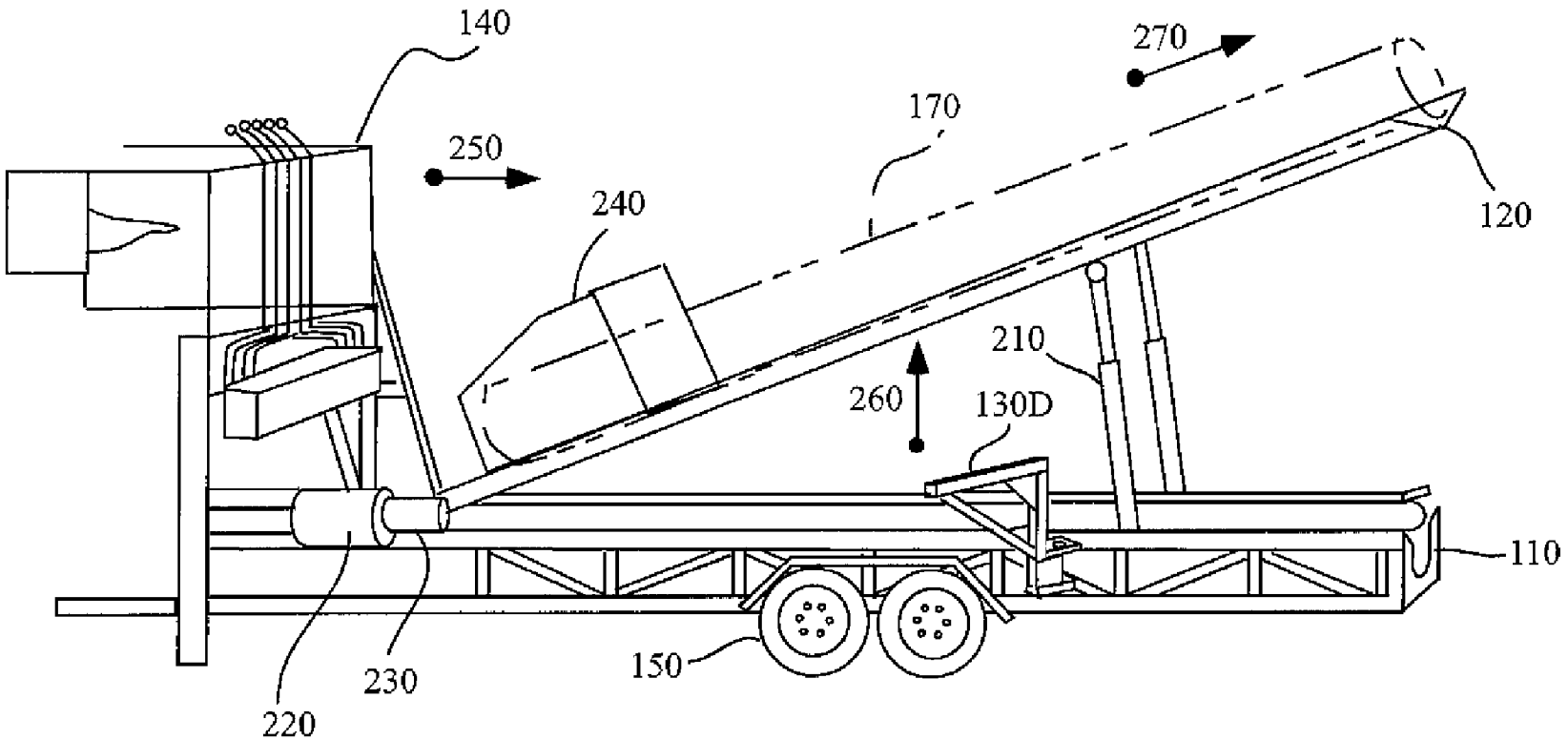
FIG. 2 shows a side view of the mobile pipe handling system with the movable tray extended upwards.

FIG. 2 depicts the base 110, the movable tray 120, drill pipe loaders 130 positioned near the base, and a drill pipe resting on the movable tray 120. When the lifter 210 is extended, the movable tray 120 tilts upwards separated from the base 110. The movable pipe tray 120 is connected to the lifter 210 and a pivot point 220 located at one end of the movable tray 120. In one possible embodiment, the lifter 210 is configured as two hydraulic cylinders, but may also be other lifting devices that are well known in the arts, such as, single cylinder configurations or electrically powered lifts.

The movable tray 120 is connected to a pivot point 220. The pivot point 220 is part of the adjuster 230, which is connected to the base. The adjuster 230 extends inwards and outwards in a direction parallel to the base 110. In one possible embodiment, the adjuster 230 is configured as one hydraulic cylinder, although other configurations may include more than one element which is used to adjust the movable tray 120.

The drill pipe 170 is also shown inserted into a glove 240. The glove 240 is connected to a pipe positioner 530 that supports the drill pipe 170 as it progresses up and down the movable tray 120. The glove 240 is configured to inset in the movable tray 120 and receive an end of the drill pipe 170. Accordingly, a glove is a receptacle for pipes or something that otherwise secures the ends of the pipes, such as a mechanism that compressively engages the pipe or fits into and abuts the or can serve as a stop as the movable tray 120 is lifted upwards. In some embodiments the drill pipe 170 is held into position by gravity force or a pipe holder 810 (see FIGS. 9, 10). The pipe holder 810 is connected to the glove 240.

From the foregoing it can be appreciated that the tray provides three degrees of freedom when moving the drill pipe 170. The first degree of freedom is the adjuster 230 which moves the entire tray along one axis 250, the second degree of freedom is the lifter 210, which moves the movable tray up and down along the second axis 260, and the pipe positioner 530, which transports the pipe along the third axis 270 parallel to the movable tray 120.

Figure 3:
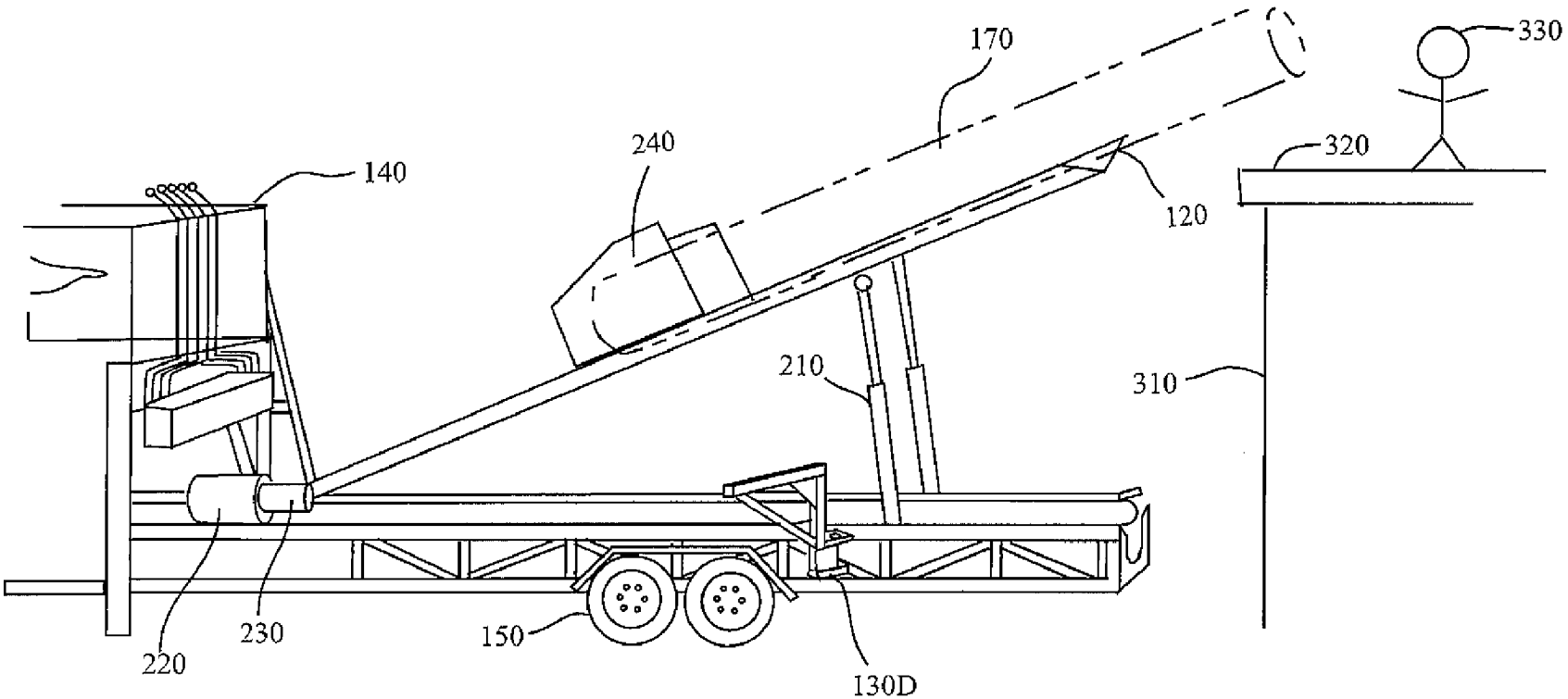
FIG. 3 shows a side view of the mobile pipe handling system with the pipe positioner transporting the pipe up the movable tray.

FIG. 3 shows the pipe handling system with the drill pipe 170 transported farther up the movable tray such that a portion of the drill pipe 170 extends over the derrick floor 320 and the derrick platform 310. On the derrick floor 320 is usually an operator 330 who is monitoring the movement of the drill pipe 170 to the derrick floor 320.

Figure 4:
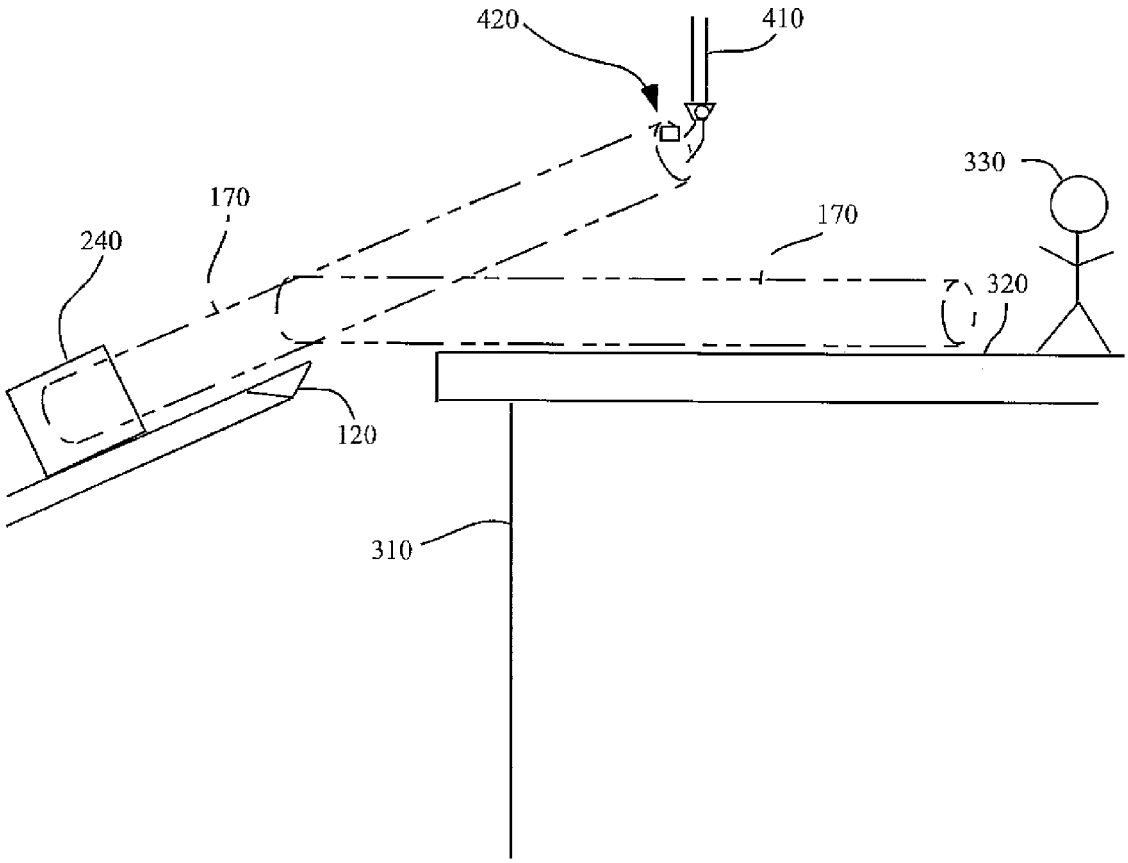
FIG. 4 shows a side view of the mobile pipe handling system positioned near the derrick floor and the pipe connected to an elevator.

FIG. 4 depicts where the operator 330 has attached an elevator 410 to an end 420 of the drill pipe 170. The elevator 410 then raises the pipe away from the movable tray 120 The glove 240 is the moved back down the movable tray 120 and the movable is lowered parallel to the base. The cycle time of this process varies, but generally can occur in a period from 10 seconds to 120 seconds.

When drill pipe 170 is moved from the derrick to the ground, the reverse process occurs. The drill pipe is lowered to an operator 330 and the glove 240 is brought up to the end of the movable tray 120 and the drill pipe is placed inside the glove 240. The drill pipe 170 is then lowered down the movable tray 120 to the ground where it is unloaded.

Figure 5:
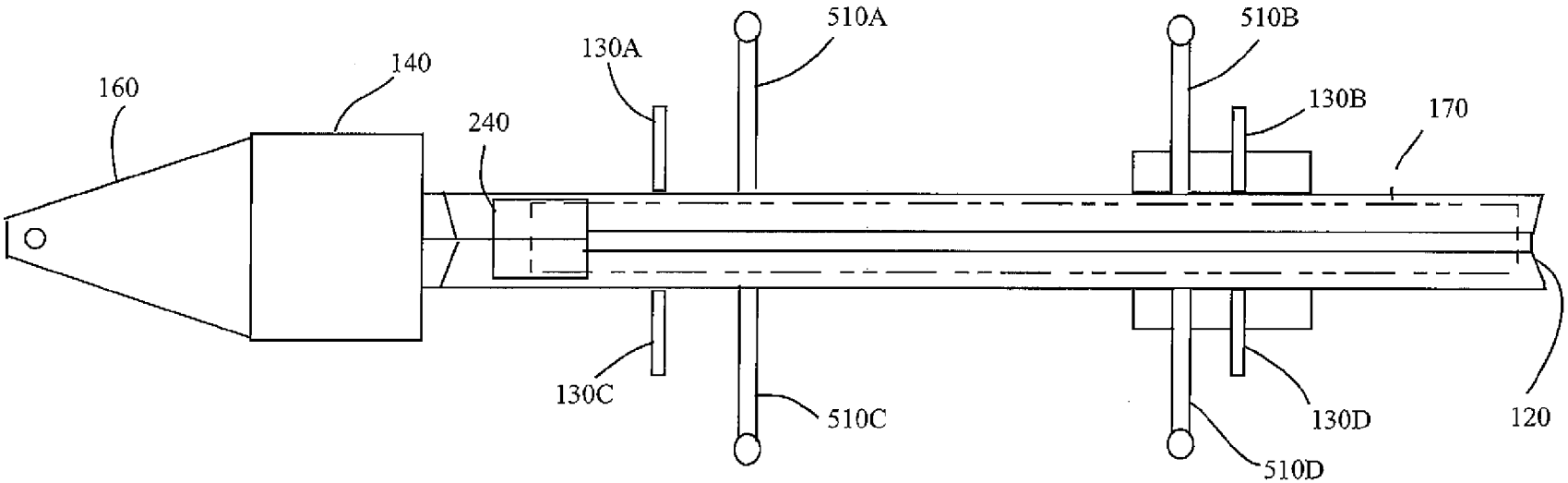
FIG. 5 shows a top view of the mobile pipe handling system.

FIG. 5 is a top view of the pipe handling system and shows the movable tray 120, the loaders 130, the control system 140, and the hitch 160. Also attached to the pipe handling system are stabilizers 510. The stabilizers 510 provide lateral support to the pipe handling system when the movable tray 120 is extended to the drilling floor, as shown in FIGS. 3 and 4. In one possible embodiment, the stabilizers are shown as four separate "swing-out" stabilizers 510A, 510B, 510C, and 510D that are pivotably connected to base 110. On each side of the base, there is a pair of spaced-apart stabilizers. Of course, there may be a single elongate stabilizer on one side or more than two stabilizers on a side, consistent with the objective of providing lateral stability at each side of the base. The stabilizers may swing-out from the base or otherwise movable from compact position against or in the base. The stabilizers may be nested within the base such that the stabilizers are in actual contact with the base or are in close physical proximity to the base without necessarily coming into contact with the base. This arrangement facilitates the mobility of the overall pipe handling system. The loaders may also be arranged on with the base in a similar nested base.

Figure 6:
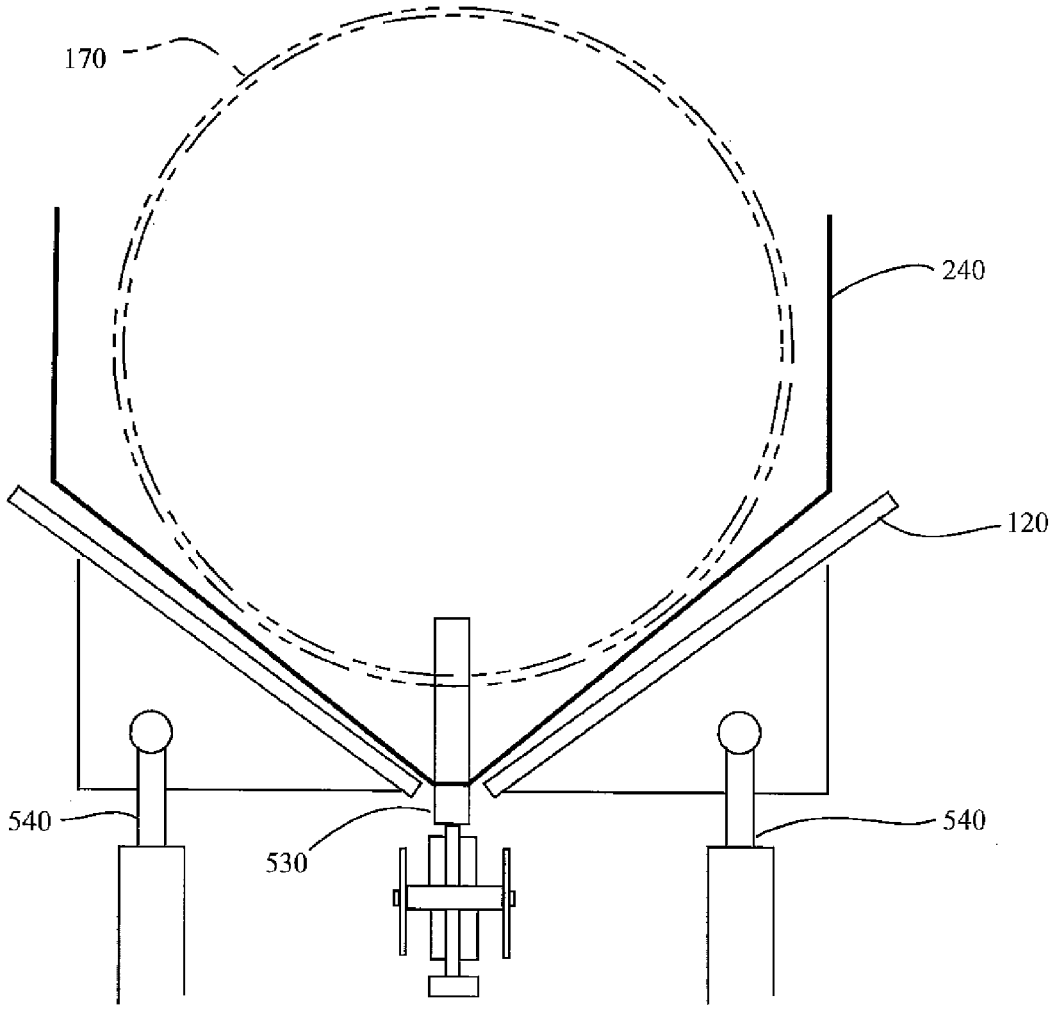
FIG. 6 shows the front view of the mobile pipe handling system depicting the movable tray and one embodiment of the pipe positioning system.

FIG. 6 depicts a close-up end view of the movable pipe tray 120 that supports the glove 240. Inset in the glove is the drill pipe 170 which abuts the inside of the glove 240. The glove 240 is attached to a positioner 530. In one possible embodiment, the positioner 530 is chain that is able to move the glove 240 up and down along the movable tray.

As shown in FIG. 6, each side of the movable tray is bifurcated into a left panel and a right panel. The bifurcation allows a groove for the positioner to operate.

Attached to one side of the movable tray is a rotator 540. The rotator 540 adjusts the movable tray relative to the base (not shown). In one position the rotator 540 is adjusted such that the right panel and the left panel of the movable tray are approximately equidistant (the level position) from the base. This is a suitable position for raising and lowering the movable tray 120 to minimize a loss of drill pipe 170 from rolling out of the movable tray 120. In one position, the rotator 540 is retracted to allow the right and left panel of the movable tray 120 to accept the drill pipe 170. In the other position the rotator 540 is extended to allow the right and left panel of the movable tray 120 to eject the drill pipe 170.

Figure 7:
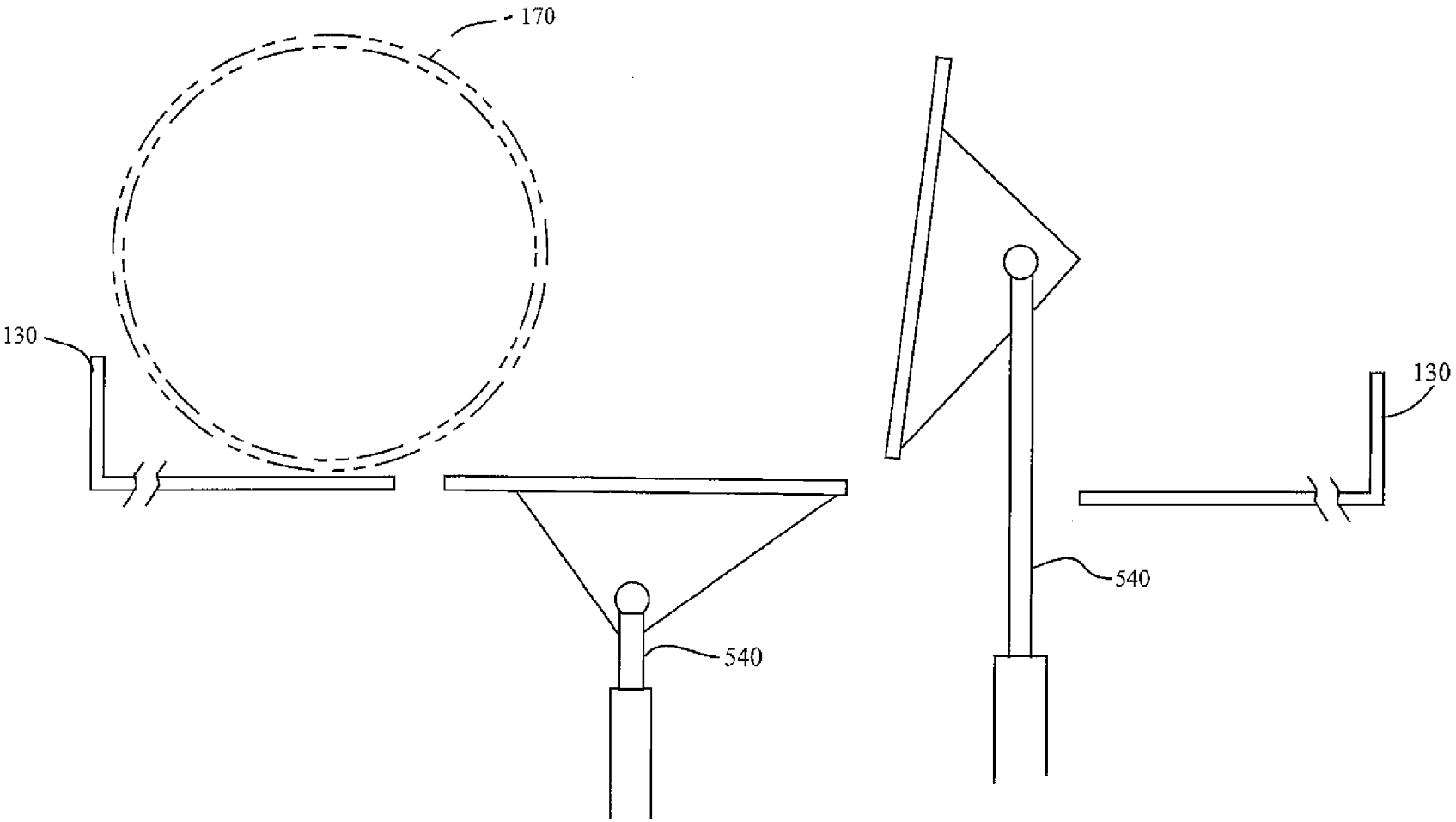
FIG. 7 depicts a front view of the mobile pipe handling system and the swing out loading rack.

In FIG. 7, the rotator 540 is rotated to accept the drill pipe 170 from the loading rack 130.

Figure 8:
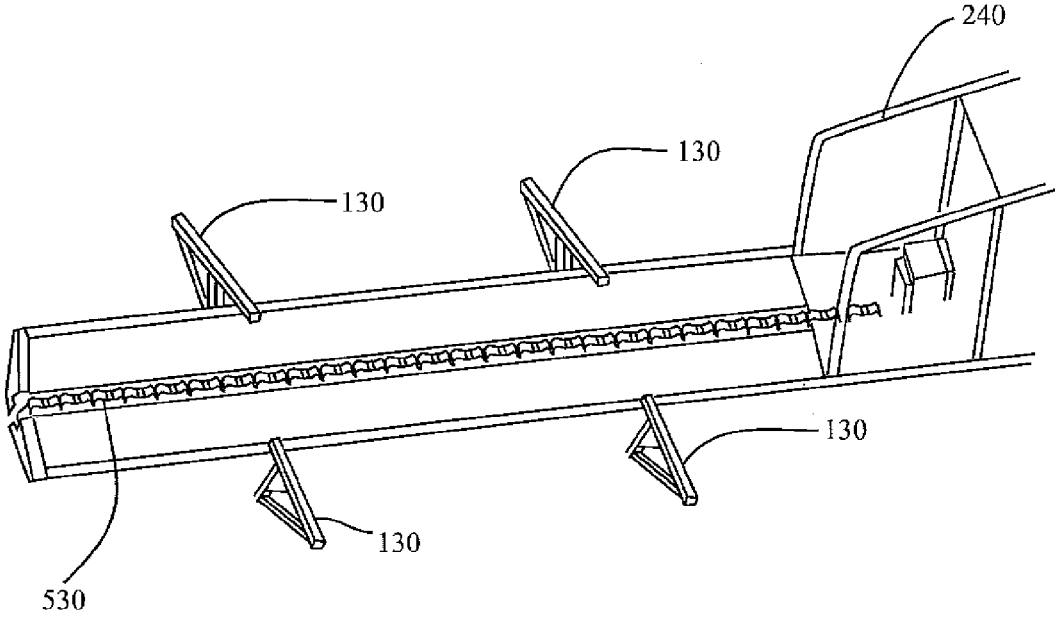
FIG. 8 depicts a top view of the mobile pipe handling system showing the pipe glove connected to the chain drive.

FIG. 8 is a top side view of the pipe handling system is shown with the glove 240, the positioned 530 and the loaders 130.

Figure 9:
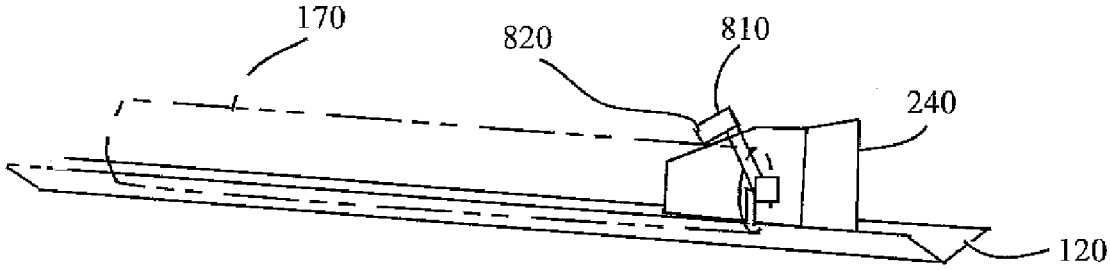
FIG. 9 shows a side view of the mobile pipe handling system with the pipe glove and the rotating pipe holder.
Figure 10:
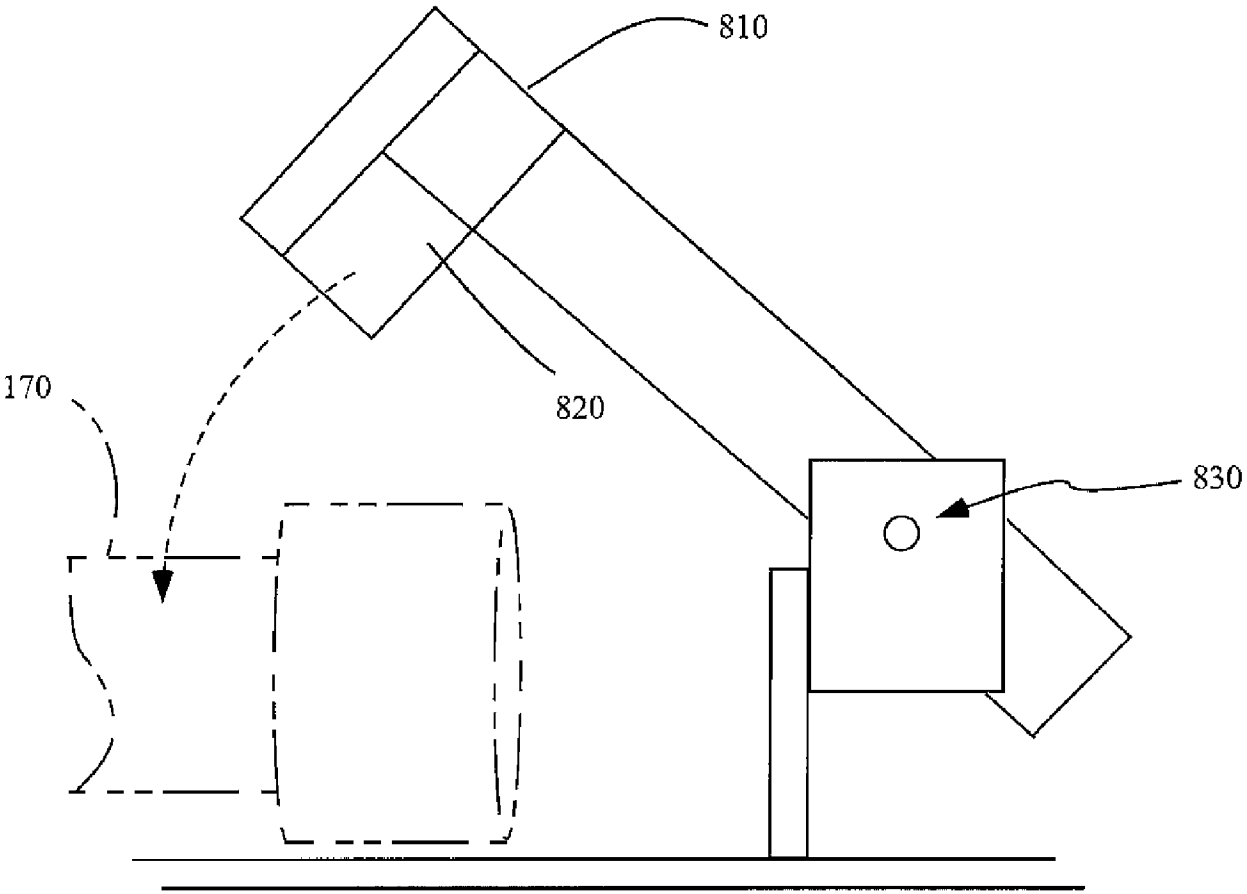
FIG. 10 shows a close up side view of the rotating pipe holder as shown in FIG. 9.

FIGS. 9 and 10 shows a side view of the pipe handling system 810. The movable tray 120 supports the glove 240, which also includes a pipe holder 810. The pipe holder 810 has a pipe holder clip 820 and a pipe holder pivot point 830. The pipe holder clip 820 is placed over the drill pipe 170 by rotating the pipe holder clip 820 on the pivot point 830.

Figure 11:
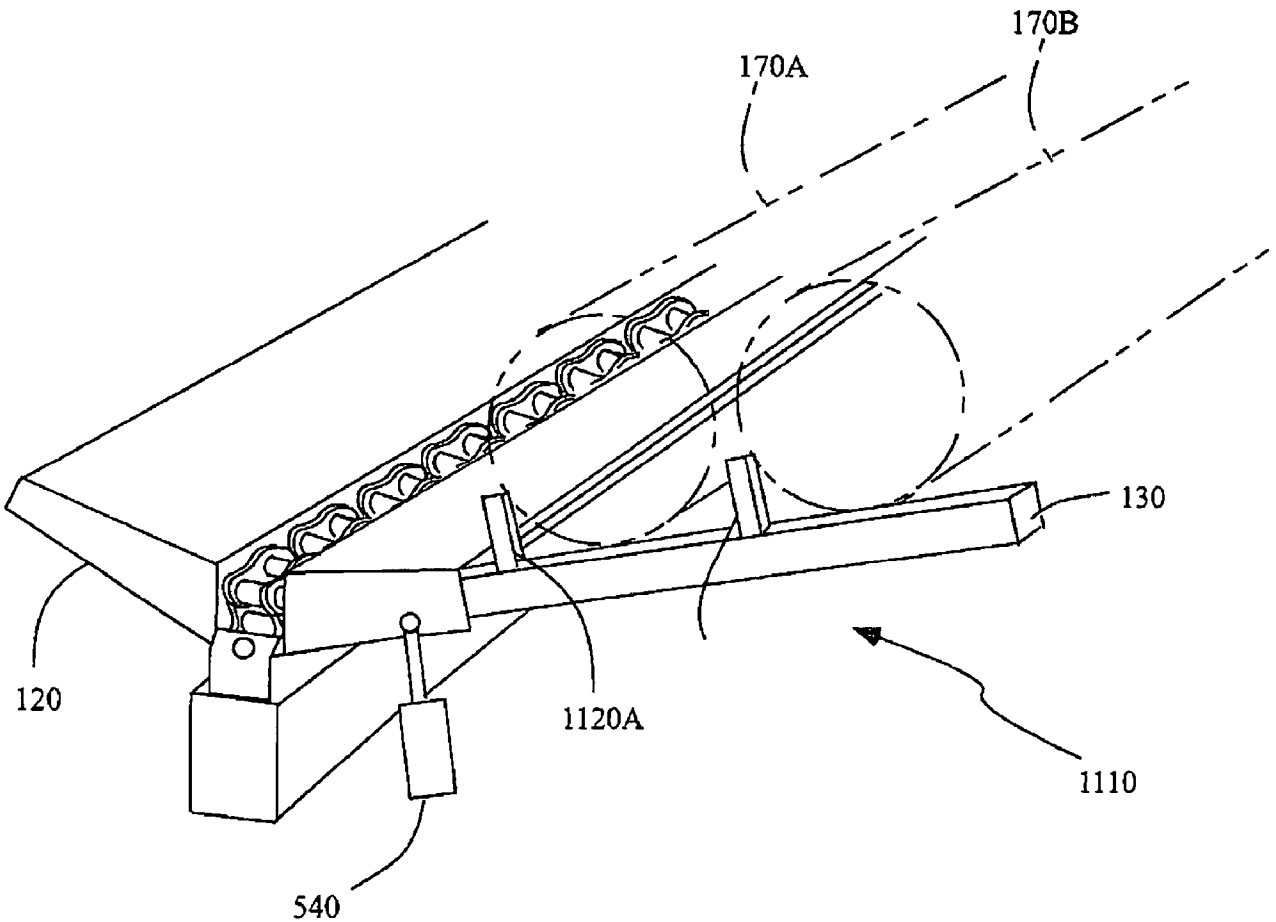
FIG. 11 shows a side view of the loadable rack system positioned near the movable tray.

FIG. 11 depicts a drill pipe sequencer 1110. The drill pipe sequencer prevents multiple joints of the drill pipe 170 from being loaded on the movable tray 120 at a single time. The drill pipe sequencer 1110 is integrated as part of the loaders 130. The loader 130 incorporates a sequencer 1110 with of retractable stops 1110A, 1110B. The retractable stops 1110A, 1110B restrict the movement of the drill pipe 170A, 170B, onto the movable tray 120. The retractable stops 1110 are separated by approximately one drill pipe diameter.

The number of retractable stops 1110A, 1110B may be increased to any number of retractable stops depending on the length of the loader 130.

When the drill pipe 170 is first loaded on the loader 130, all but the closest retractable stop 1110A is depressed), the next closest retractable stop 1110B is then raised. The first drill pipe 170A is then loaded, by lowering the closest retractable stop 1110A. The first drill pipe then rolls onto the movable tray 120. This process is repeated, shifting the drill pipe along the loader.

The approximate dimensions of the typical drill pipe range in size from 2¾" to 16" in diameter. Drill pipes of larger diameters or smaller diameters may also be used in situations where there are unique design requirements in downhole operations. To accommodate these non-standard situations, certain components of the loader 130 may be sized accordingly.

FIG. 1 depicts a control station 140 for controlling the operation of the pipe handling system. The control station may consist of a switch or a lever (not shown) that enables an actuator to operate an individual component. For example, a switch may enable the positioner 530 to move forward and backward. Likewise, a switch may operate the lifters 210 up to reach the level of the platform 310.

These switches may be connected to a computer controlled system and are under programmatic control. The computer controlled system would read the state of each individual drill pipe on the pipe handling system and then determines which switch to enable in an automatic manner. The system may include machine vision technology to recognize and load pipes in an automated fashion. Also, the pipe handling system can be operated wirelessly.

An example embodiment of the inventive subject matter has the overall length of the pipe handling system 100 from the hitch 160 along the length of the base is approximately 59 feet. The length of the movable tray 120 is approximately 41½ feet. The width of the pipe handling system 100 is approximately 3½ feet. The pipe handling system 100 may be constructed from structural tube steel A500 grade B. In this example embodiment, the pipe handling cycle time (e.g., moving a pipe from the loading tray to the derrick floor) is approximately 40 seconds in which to move a 16" drill pipe from 3 feet to a 25 foot height.

Persons skilled in the art will recognize that many modifications and variations are possible in the details, materials, and arrangements of the parts and actions which have been described and illustrated in order to explain the nature of this inventive concept and that such modifications and variations do not depart from the spirit and scope of the teachings and claims contained therein.

What is currently claimed:

1. A drill pipe handling system, comprising:

an elongated base being dimensioned sufficient to receive and support a movable tray in a position parallel to the base; the movable tray being movably coupled to the base at one end so as to provide at least one degree of freedom of movement, the movable tray being dimensioned to receive at least one section of pipe, and one end of the movable tray is separable from the base;

a pipe positioner slidably disposed in the movable tray for transporting pipe; and a loader disposed adjacent to the movable tray, when the tray is parallel to the base; and an adjuster;

wherein the loader is configured to receive and feed a section of pipe into the tray and where the loader is movable from a position nested in or against the base to a deployed position extending from the base; and wherein when the adjuster is extended the movable tray moves along the base; and wherein the loader further comprises at least one extendable stabilizer on each of opposite sides of the base, each stabilizer movable from a position nested in or against the base to a deployed position extending from the base; and wherein one end of a pipe is supportable by a glove, the glove having a holding side and an attachment side, the holding side of the glove contactable to the one end of the pipe, and the attachment side is connectable to a mechanism that moves pipe, wherein the pipe moves as the glove moves and as the mechanism moves.

2. The drill pipe handling system of claim 1 wherein the mechanism is a chain or a cable.

3. A drill pipe handling system, comprising:

an elongated base being dimensioned sufficient to receive and support a movable tray in a position parallel to the base; the movable tray being movably coupled to the base at one end so as to provide at least one degree of freedom of movement, the movable tray being dimensioned to receive at least one section of pipe, and one end of the movable tray is separable from the base;

a pipe positioner slidably disposed in the movable tray for transporting pipe; and a loader disposed adjacent to the movable tray, when the tray is parallel to the base;

and an adjuster, and wherein the loader is configured to receive and feed a section of pipe into the tray and where the loader is movable from a position nested in or against the base to a deployed position extending from the base; and wherein the loader further comprises a number of retractable stops that are perpendicular to the loader and dimensioned to stop a pipe from movement; and wherein the retractable stops are separated by one pipe diameter.

4. The drill pipe handling system of claim 3 wherein the retractable stops are independently adjustable.

5. The drill pipe handling system of claim 4 wherein each retractable stop is adjusted downwards in sequential manner to allow the movement of pipe from one position on the loader to the movable tray.

6. A method of moving pipe to the floor of a derrick comprising:

placing a drill pipe onto a side loader that is extendable perpendicularly from an elongate base, rolling or sliding the drill pipe from the side loader onto a movable tray that is parallel to the base and configured to receive the pipe in parallel with the base;

rotating the movable tray from the parallel position to vertically support the pipe; raising one end of the tray with the pipe to the derrick floor;

adjusting the movable tray along the base with an adjuster, such that the movable tray can extend beyond one end of the base, and transporting the pipe forward on the movable tray to the derrick floor.

7. The method of claim 6 further comprising:

selecting a single pipe on the side loader; and stopping the adjacent pipe from moving towards the side loader.

8. The method of moving drill pipe to the floor of a derrick as in claim 6 wherein one end of the pipe is prevented from movement by a holder.

9. The method of claim 6 wherein the operations are under programmatic control.

* * * * *